US008931542B2

(12) United States Patent
Farkas

(10) Patent No.: US 8,931,542 B2
(45) Date of Patent: Jan. 13, 2015

(54) METHOD OF MAKING A REFRACTORY MOLD

(71) Applicant: Attila P. Farkas, Milford, NH (US)

(72) Inventor: Attila P. Farkas, Milford, NH (US)

(73) Assignee: Metal Casting Technology, Inc., Milford, NH (US)

( * ) Notice: Subject to any disclaimer, the term of this patent is extended or adjusted under 35 U.S.C. 154(b) by 55 days.

(21) Appl. No.: 13/835,196

(22) Filed: Mar. 15, 2013

(65) Prior Publication Data

US 2014/0262105 A1 Sep. 18, 2014

(51) Int. Cl.
*B22C 9/04* (2006.01)
*B22C 7/02* (2006.01)

(52) U.S. Cl.
CPC ... *B22C 9/04* (2013.01); *B22C 7/02* (2013.01); *B22C 9/043* (2013.01)
USPC ..... 164/6; 164/24

(58) Field of Classification Search
CPC ..... B22C 9/02; B22C 9/04; B22C 9/043
USPC ..... 164/6, 15, 23, 24, 516, 34, 35, 45, 305, 164/349, 361, 410
See application file for complete search history.

(56) References Cited

U.S. PATENT DOCUMENTS

| | | | | |
|---|---|---|---|---|
| 792,992 | A | 6/1905 | Kelly | |
| 971,045 | A | 9/1910 | Kerr | |
| 3,186,041 | A * | 6/1965 | Horton | 164/516 |
| 3,259,949 | A | 7/1966 | Moore | |
| 3,416,593 | A | 12/1968 | Hathorn | |
| 3,557,867 | A | 1/1971 | Krzyzanowski | |
| 3,861,447 | A | 1/1975 | Hondo | |
| 4,068,704 | A * | 1/1978 | Wittmoser | 164/160.1 |
| 4,532,976 | A * | 8/1985 | Chandley | 164/363 |
| 4,730,657 | A | 3/1988 | Carson et al. | |
| 4,796,686 | A | 1/1989 | Gayso | |
| 4,828,006 | A | 5/1989 | Vander Jagt | |
| 4,854,368 | A | 8/1989 | Vezirian | |
| 5,069,271 | A * | 12/1991 | Chandley et al. | 164/516 |
| 5,372,177 | A | 12/1994 | Foster | |
| 5,592,984 | A | 1/1997 | Schmiedeknecht et al. | |

(Continued)

FOREIGN PATENT DOCUMENTS

| | | | |
|---|---|---|---|
| EP | 1254751 | A1 | 11/2002 |
| JP | 56056756 | A | 5/1981 |

(Continued)

OTHER PUBLICATIONS

U.S. Appl. No. 13/835,340 titled "Refractory Mold" filed Mar. 15, 2013.

(Continued)

*Primary Examiner* — Kevin P Kerns
(74) *Attorney, Agent, or Firm* — Cantor Colburn LLP

(57) ABSTRACT

A method of making a bonded refractory mold is disclosed. The method includes forming a fugitive pattern including a thermally removable material. The method also includes forming a refractory mold including a mold wall, the mold wall including a refractory material and defining a sprue, a gate and a mold cavity, the gate having a gate inlet opening into the sprue and a gate outlet opening into the mold cavity, the mold defined by the fugitive pattern. The method further includes forming a gas vent that extends through the mold wall. The method also includes covering the gas vent with a gas permeable cover.

21 Claims, 6 Drawing Sheets

(56) References Cited

U.S. PATENT DOCUMENTS

| | | | | |
|---|---|---|---|---|
| 6,298,904 | B2 | 10/2001 | Polich | |
| 6,453,976 | B1 * | 9/2002 | Chandley et al. | 164/34 |
| 6,889,745 | B2 | 5/2005 | Redemske | |
| 6,923,240 | B2 | 8/2005 | Tosco | |
| 7,204,296 | B2 | 4/2007 | Redemske et al. | |
| 7,231,955 | B1 | 6/2007 | Bullied et al. | |
| 2007/0215315 | A1 | 9/2007 | Redemske et al. | |
| 2008/0023170 | A1 | 1/2008 | Farkas et al. | |
| 2009/0294086 | A1 | 12/2009 | Yang | |

FOREIGN PATENT DOCUMENTS

| | | | | |
|---|---|---|---|---|
| JP | 58132347 | | 8/1983 | |
| JP | 07314117 | A | 12/1995 | |
| JP | 8-206777 | A * | 8/1996 | B22C 9/04 |
| SU | 1256848 | A1 | 9/1986 | |

OTHER PUBLICATIONS

U.S. Appl. No. 13/835,271 titled "Method of Using a Refractory Mold" filed Mar. 15, 2013.

Database WP, Week 198127, Thomson Scientific, London GB; AN 1981-48685D, 1 page.

International Search Report for PCT/US2014/015259, mailed May 20, 2014.

International Search Report for PCT/US2014/015266, mailed May 26, 2014.

International Search Report for PCT/US2014/015271, mailed May 26, 2014.

* cited by examiner

METHOD OF MAKING A REFRACTORY MOLD

CROSS REFERENCE TO RELATED APPLICATIONS

This application contains subject matter related to the subject matter of co-pending U.S. patent application Ser. No. 13/835,340 entitled "REFRACTORY MOLD" and Ser. No. 13/835,271 entitled "METHOD OF USING A REFRACTORY MOLD", which are assigned to the same assignee as this application, Metal Casting Technology, Inc. of Milford, N.H., which are being filed on the same date as this application, and which are hereby incorporated by reference herein in their entirety

FIELD OF THE INVENTION

The subject invention relates generally to a method of making a refractory mold and, more particularly, to a method of making a vented refractory mold.

BACKGROUND

The investment casting process typically uses a refractory mold that is constructed by the buildup of successive layers of ceramic particles bonded with an inorganic binder around an expendable pattern material such as wax, plastic and the like. The finished refractory mold is usually formed as a shell mold around a fugitive (expendable and removable) pattern. The refractory shell mold is made thick and strong enough to withstand: 1) the stresses of steam autoclave or flash fire pattern elimination, 2) the passage through a burnout oven, 3) the withstanding of thermal and metallostatic pressures during the casting of molten metal, and 4) the physical handling involved between these processing steps. Building a shell mold of this strength usually requires at least 5 coats of refractory slurry and refractory stucco resulting in a mold wall typically 4 to 10 mm thick thus requiring a substantial amount of refractory material. The layers also require a long time for the binders to dry and harden thus resulting in a slow process with considerable work in process inventory.

The bonded refractory shell molds are typically loaded into a batch or continuous oven heated by combustion of gas or oil and heated to a temperature of 1600° F. to 2000° F. The refractory shell molds are heated by radiation and conduction to the outside surface of the shell mold. Typically less than 5% of the heat generated by the oven is absorbed by the refractory mold and greater than 95% of the heat generated by the oven is wasted by passage out through the oven exhaust system.

The heated refractory molds are removed from the oven and molten metal or alloy is cast into them. An elevated mold temperature at time of cast is desirable for the casting of high melting temperature alloys such as ferrous alloys to prevent misruns, gas entrapment, hot tear and shrinkage defects.

The trend in investment casting is to make the refractory shell mold as thin as possible to reduce the cost of the mold as described above. The use of thin shell molds has required the use of support media to prevent mold failure as described U.S. Pat. No. 5,069,271 to Chandley et al. The '271 patent discloses the use of bonded ceramic shell molds made as thin as possible such as less than 0.12 inch in thickness. Unbonded support particulate media is compacted around the thin hot refractory shell mold after it is removed from the preheating oven. The unbonded support media acts to resist the stresses applied to the shell mold during casting so as to prevent mold failure.

Thin shell molds, however, cool off more quickly than thicker molds following removal from the mold preheat oven and after surrounding the shell with support media. This fast cooling leads to lower mold temperatures at the time of casting. Low mold temperatures can contribute to defects such as misruns, shrinkage, entrapped gas and hot tears, especially in thin castings.

U.S. Pat. No. 6,889,745 to Redemske teaches a thermally efficient method for heating a gas permeable wall of a bonded refractory mold wherein the mold wall defines a mold cavity in which molten metal or alloy is cast. The mold wall is heated by the transfer of heat from hot gas flowing inside of the mold cavity to the mold wall. Hot gas is flowed from a hot gas source outside the mold through the mold cavity and gas permeable mold wall to a lower pressure region exterior of the mold to control temperature of an interior surface of the mold wall. Despite the usefulness of the mold heating process described in the '745 patent, uneven pattern elimination and uneven mold heating have been observed, where the top of the mold heats much faster than the bottom, which can result in shell cracking at the top and incomplete pattern elimination at the bottom. This may be addressed by heating the thin shell refractory molds at a slower rate in order to promote temperature uniformity, but results in very long burn-out cycles; as long as seven hours. In addition, due to initial low gas permeability as binders are burned out of the mold wall, pattern elimination can be problematic due to difficulty in starting and operating burners at the low burn rates governed by poor gas permeability, resulting in multiple restarts of the burner to establish a reliable flame. In addition, the mold heating method described in the '745 patent is useful with thin shell refractory molds that have relatively high gas permeability through the mold walls as described, but is not useful for thick shell refractory molds having relatively low gas permeability or no gas permeability.

Accordingly, it is desirable to provide refractory molds and methods of making and using the molds that are capable of maintaining uniform mold temperatures throughout the mold and that are useful for all types of refractory molds, regardless of the thickness gas permeability of the mold wall.

SUMMARY OF THE INVENTION

In an exemplary embodiment, a method of making a bonded refractory mold is disclosed. The method includes forming a fugitive pattern comprising a thermally removable material. The method also includes forming a refractory mold comprising a mold wall, the mold wall comprising a refractory material and defining a sprue, a gate and a mold cavity, the gate having a gate inlet opening into the sprue and a gate outlet opening into the mold cavity, the mold defined by the fugitive pattern. The method further includes forming a gas vent that extends through the mold wall. The method also includes covering the gas vent with a gas permeable cover.

The above features and advantages and other features and advantages of the present invention are readily apparent from the following detailed description of the invention when taken in connection with the accompanying drawings.

BRIEF DESCRIPTION OF THE DRAWINGS

Other objects, features, advantages and details appear, by way of example only, in the following detailed description of embodiments, the detailed description referring to the drawings in which.

DESCRIPTION OF THE EMBODIMENTS

The present invention relates generally to a refractory mold, and a method of making and using the refractory mold. The mold is configured to be heated by the flow of a hot gas from a hot gas source through one or more refractory conduit(s) and associated gas vents, particularly in the sprue or gates, or a combination thereof, into a space or region exterior of the mold, particularly a support medium surrounding the mold. The heating of the region located exterior of the mold wall, and more particularly the support medium, significantly improves the heating of the mold and enhances elimination of the pattern assembly from within the mold.

Figure 1:
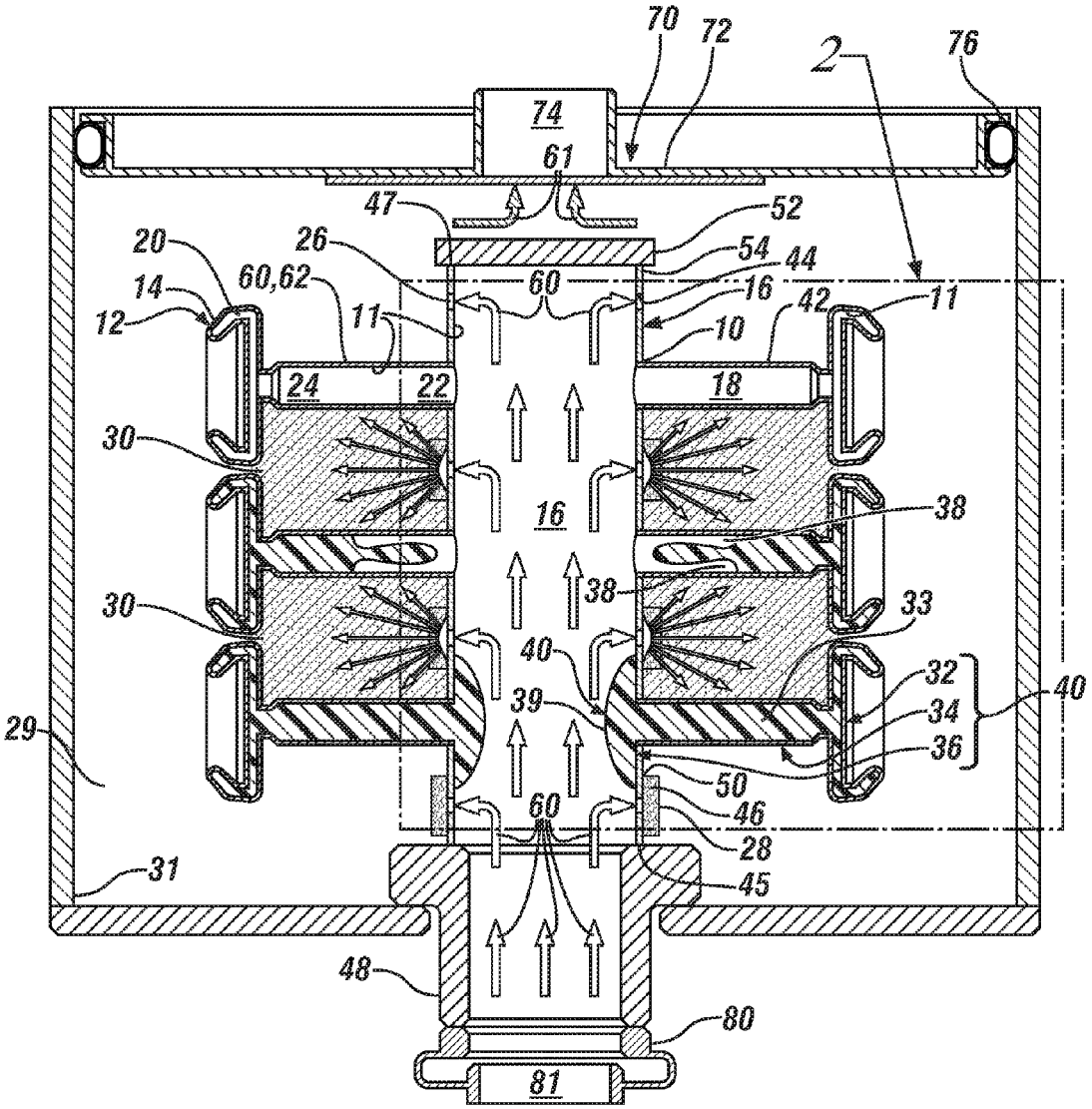
FIG. 1 is a partial cross-sectional view of an exemplary embodiment of a refractory mold, support medium and casting flask as disclosed herein.
Figure 2:
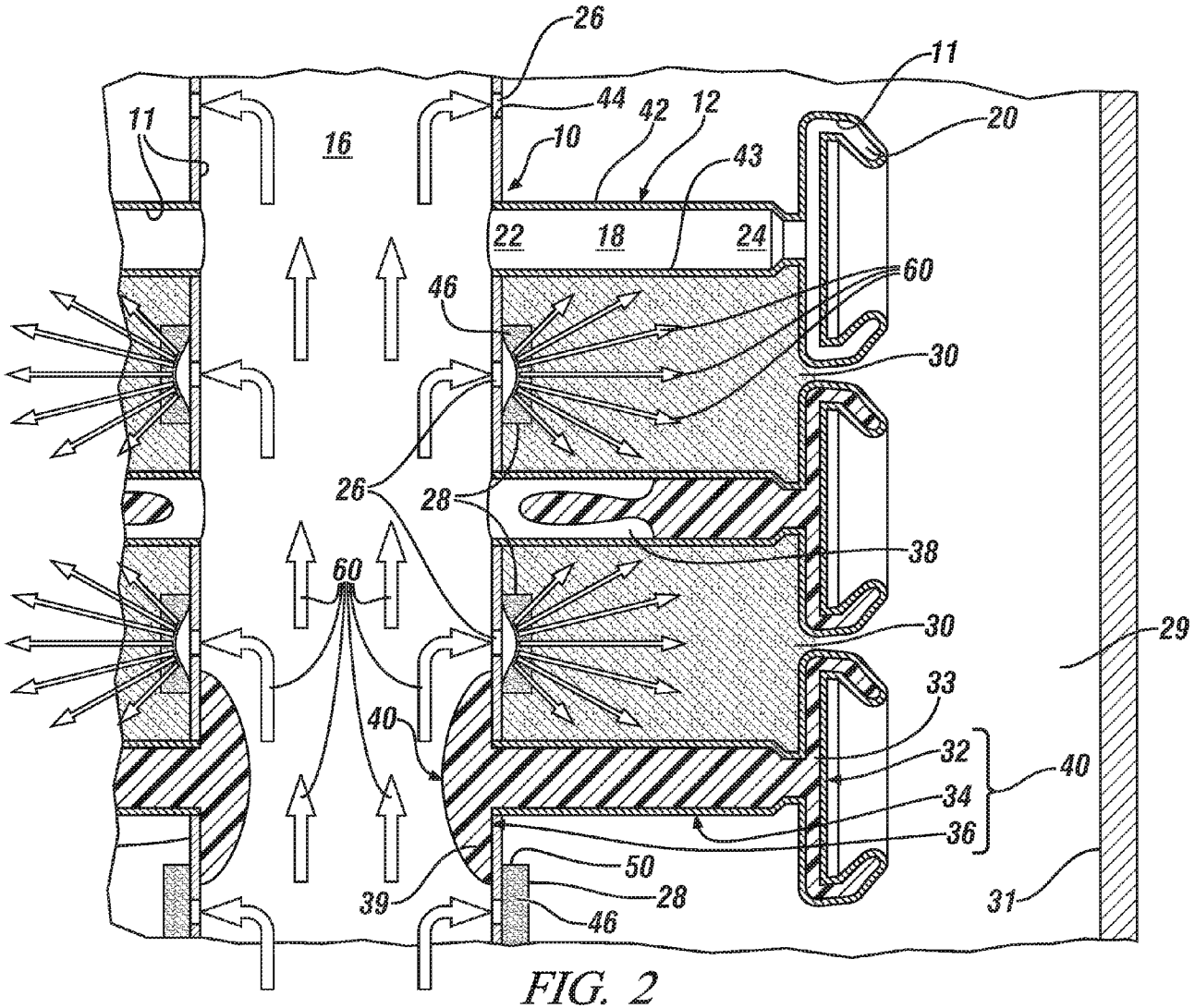
FIG. 2 is an enlarged section of FIG. 1 showing in more detail an exemplary embodiment of a refractory mold with sprue vents as disclosed herein.

Referring to the figures, and particularly FIGS. 1 and 2, in accordance with an exemplary embodiment of the present invention, a bonded refractory mold 10 is illustrated. Three stages of pattern elimination are depicted, proceeding from bottom to top—start of pattern elimination, early stage of pattern elimination and mold heating after pattern elimination is completed. The mold 10 includes a mold wall 12. The mold wall 12 comprises a bonded refractory material 14 and defines a refractory conduit 11, including a sprue 16 and at least one gate 18 and a mold cavity 20. The gate 18 has a gate inlet 22 opening into the sprue 16 and a gate outlet 24 opening into the mold cavity 20. The mold 10 includes a gas vent 26 extending through the mold wall 12, and more particularly may include a plurality of gas vents 26. The mold 10 also includes a gas permeable refractory cover 28 covering the gas vent 26, or the plurality of gas vents. In FIGS. 1-4 some of the gates 18 and mold cavities 20 have been omitted to illustrate other aspects of the mold 10.

As depicted in FIGS. 1 and 2, in one embodiment, the mold 10 is configured to be placed in a casting flask 31 that defines a casting chamber 29 and surrounded by and encased in a support medium 30, such as a well-packed particulate support medium such as various types of casting sand. For purposes of illustration, support medium 30 is shown surrounding mold 10 between the gates 18, but it will be understood that when present, the support medium 30 will generally entirely fill the space in casting chamber 31 surrounding the mold 10. The casting flask 31 and mold 10 are configured for use in an investment casting process, and are particularly well-suited for use in conjunction with a countergravity investment casting. The mold 10, method 100 of making the mold 10 and method of using 200 the mold 10 in various casting processes are described further herein.

The mold 10 may include a mold wall 12 that is gas permeable or gas impermeable. The mold 10 may, for example, include a bonded gas permeable refractory shell mold 10 that can be made by methods well known in the investment casting industry, such as the well known lost wax investment mold-making process. For example, a fugitive (expendable) pattern assembly 40 typically made of wax, plastic foam or other expendable pattern material 33 is provided to define the mold 10 and includes one or more fugitive (i.e., removable) patterns 32 having the shape of the article to be cast. The pattern(s) 32 includes and is/are connected to expendable gate portions 34 and a sprue portion 36 or portions that are used to define the gates 18 and sprue(s) 16, respectively. The patterns 32, gate portions and sprue portions form the complete pattern assembly 40. The pattern assembly 40 is repeatedly dipped in a ceramic/inorganic binder slurry, drained of excess slurry, stuccoed with refractory or ceramic particles (stucco), and dried in air or under controlled drying conditions to build up a bonded refractory shell wall 12 of shell mold 10 on the pattern assembly 40. The slurry may include various combinations of refractory ceramic materials and binder materials and various amounts of these materials, and may be applied as any number of coating layers. In certain embodiments, the bonded refractory shell wall 12 may be relatively thin and gas permeable and be formed using several (e.g., 2-4) layers of slurry and have a thickness of about 1 to about 4 mm, and more particularly about 1 to about 2 mm, and comprise a several layer investment casting (SLIC) mold 10. In certain other embodiments, the bonded refractory shell wall 12 may be relatively thick and gas impermeable (i.e., lower permeability) and be formed using multiple (e.g., 6-10 or more) layers of slurry and have a thickness of about 10 mm or more, and comprise a conventional investment casting mold wall 12. After a desired shell mold wall 12 thickness is built up on the pattern assembly 40, the pattern assembly 40 is selectively removed by well known removal techniques, such as steam autoclave or flash fire pattern 32 elimination, leaving a green shell mold having one or more mold cavities 20 for filling with molten metal or alloy and solidification therein to form a cast article having the shape of the mold cavity 20. Alternately, the pattern 32 can be left inside the bonded refractory mold and removed later during mold heating. The pattern assembly 40 may include one or more preformed refractory conduit 11, which may comprise the sprue 16 and gates 18 attached to it for incorporation as part of the shell mold 10. The refractory conduit 11 is provided for flow of hot gases during mold preheating pursuant to the invention as well as for conducting molten metal or alloy into the mold cavity 20. In lieu of being attached to the pattern assembly 40, the refractory conduits 11 can be attached to the shell mold 10 after it is formed, or during assembly of the shell mold 10 in a casting chamber 29 of a metal casting flask 31 or housing. For countergravity casting, the refractory conduit 11 typically has the shape of a long ceramic tubular sprue 16 disposed and open at the bottom of the mold 10 to be immersed into a pool of molten metal or alloy, FIG. 3, and supply molten metal or alloy to the mold cavity(ies) 20 through a plurality of associated gates 18. The shell mold 10 can include a plurality of mold cavities 20 disposed about and along a length of a central sprue 16 as illustrated, for example, in FIGS. 1-4, where like reference numerals are used to designate like features. Similarly, for gravity casting (not shown), the shell mold 10 can also include one or more mold cavities 20. For gravity casting, the refractory conduit 11 is disposed on the top of the assembly of the shell mold 10 and typically has a funnel shape to receive molten metal or alloy from a pour vessel, such as a conventional crucible (not shown).

When the mold wall is permeable, the permeability of the bonded refractory shell mold wall 12 may be chosen to cause a gas flow rate through the mold wall suitable to transfer heat into the mold wall 12 and/or the surrounding support medium 30 at a rate sufficient to control the temperature of an interior surface of the mold wall 12. The heating rate of the mold wall 12 is proportional to the gas flow rate through the mold wall 12 and into the support medium 30. Any suitable gas flow rate may be used. In one embodiment, a gas flow rate of up to about 60 scfm (standard cubic feet per minute) has been useful and more particularly, about 50 to about 60 scfm. Larger molds and faster heating rates require higher hot gas flow rates. The hot gas flow rate through the bonded refractory mold wall is controlled by the refractory material 14 or materials used, particle shape and size distribution of the refractory flours employed in making the mold, the void fraction in the dried shell layers or coatings, the binder content and the thickness of the mold wall. The thickness of the bonded refractory mold wall 12 may range between 1.0 mm and 10 mm or more depending upon the size of the mold and other factors. The use of a bonded refractory mold wall 12 having lower gas permeability than the support medium 30 may cause a differential pressure of typically 0.9 atmospheres across the mold wall low in practice of an illustrative embodiment of the invention. The outer surface 42 of the mold 10 is typically encased in a support medium 30 within casting chamber 29, such as an unbonded particulate support medium 30 (e.g. unbonded dry foundry sand) as described in U.S. Pat. No. 5,069,271 to Chandley et. al., which is incorporated herein by reference. This pressure differential may force the hot gas to flow in a substantially uniform manner through all areas of the mold wall 12.

The type of refractory chosen for the shell mold 10 should be compatible with the metal or alloy being cast. If a support medium 30 is provided about the shell mold 10, the coefficient of thermal expansion of the shell mold wall 12 should be similar to that of the support medium 30 to prevent differential thermal expansion cracking of the bonded refractory mold 10. In addition, for larger parts, a refractory with a low coefficient of thermal expansion, such as fused silica, may be used for the bonded refractory shell mold 10 and support media 30 to prevent thermal expansion buckling of the mold cavity wall 12.

Figure 3:
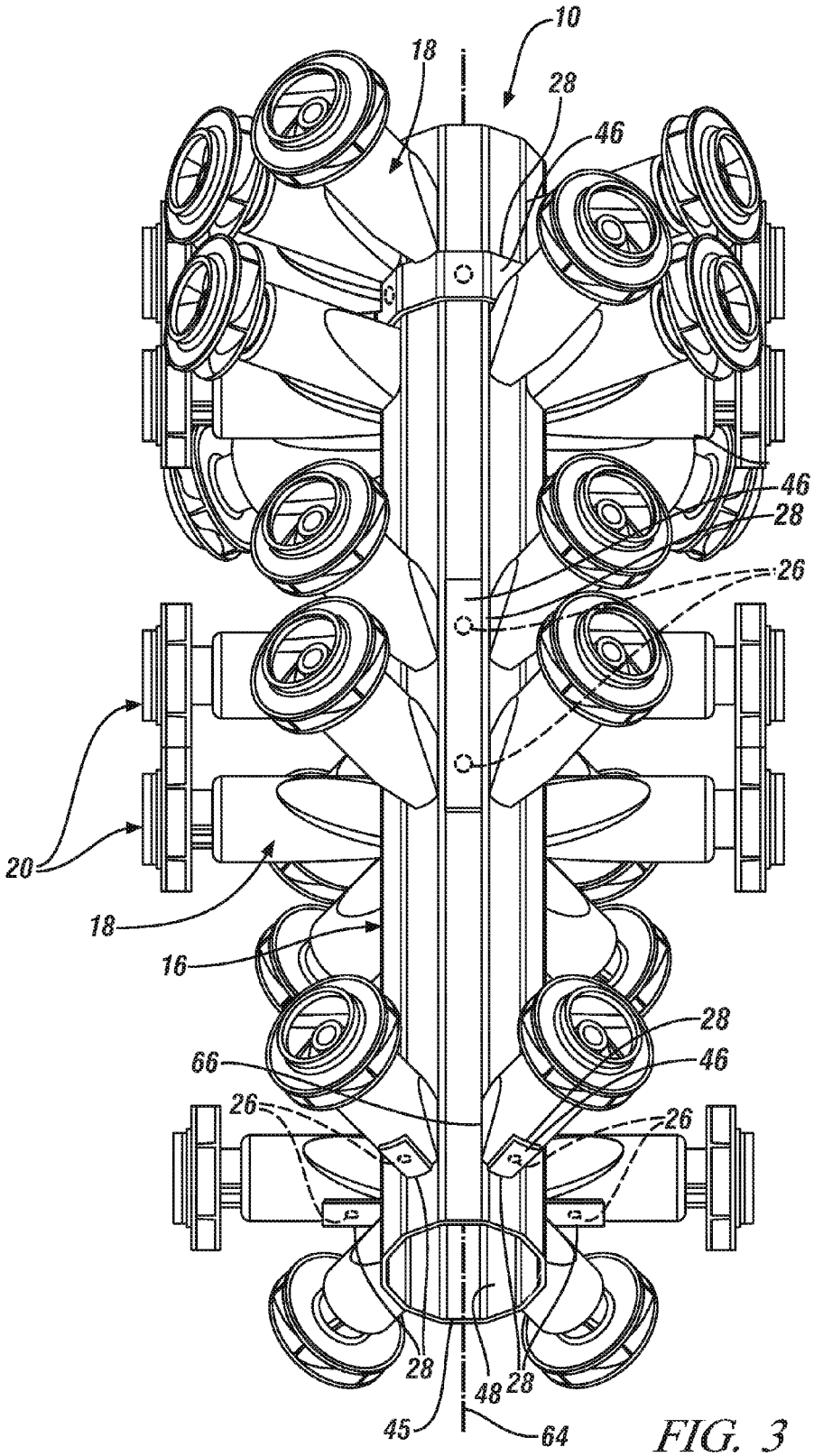
FIG. 3 is a perspective side view of a second exemplary embodiment of a refractory mold as disclosed herein.
Figure 4:
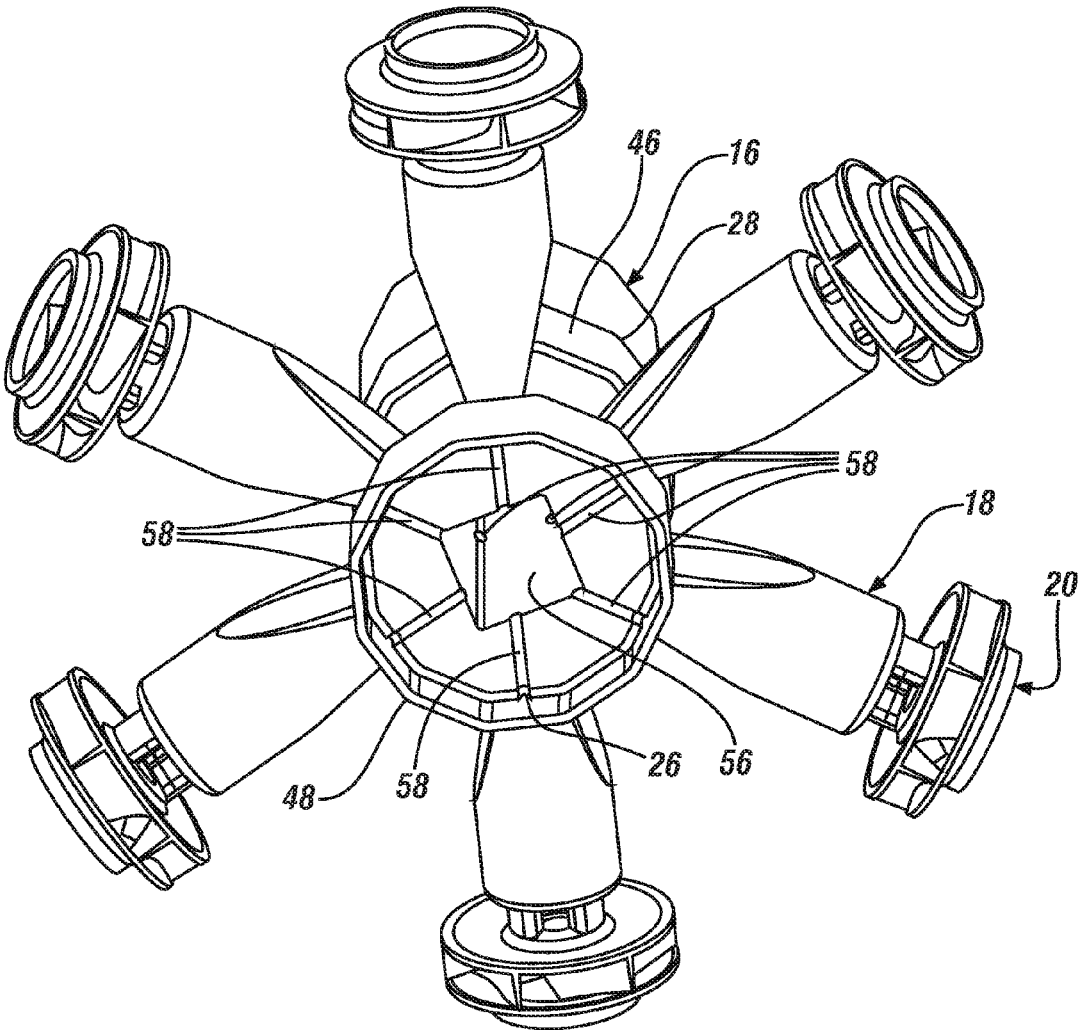
FIG. 4 is a perspective view of an embodiment of a refractory mold and pattern portion that includes a sprue channel and vent channels as disclosed herein.

Referring to FIGS. 1-4, in order to control, and more particularly to increase, the permeability of the mold wall 12 and promote heating of the support media 30 and outer surface 42 of the mold 10, the mold wall 12 also includes one or more gas vents 26. The gas vent 26 or vents may be located in any suitable portion of the mold wall 12, including being located in the gate or the sprue. When a plurality of gas vents 26 are employed, they may be located in the gates 18 or the sprue 16, or a combination thereof. For example, where the gates 18 and associated mold cavities 20 are radially spaced about the circumference or periphery of the sprue 16 in a ring or ring-like configuration, the gas vents 26 may be located in the sprue 16 axially spaced between the rings of gates 18/mold cavities 20 as illustrated in FIG. 1. In this countergravity mold configuration, the hot combustion gas used to remove the pattern assembly 40 is passed through the gas vents 26 to heat the axially adjacent rings of gates 18/mold cavities 20 (i.e., above and below the respective gas vent). In another example, where the gates 18 and associated mold cavities 20 are radially spaced about the circumference or periphery of the sprue 16 in a ring or ring-like configuration, the gas vents 26 may also be located in the sprue 16 between adjacent radially spaced gates 18/mold cavities 20 as illustrated in FIG. 3. In this countergravity mold configuration, the hot combustion gas used to remove the pattern assembly 40 is passed through the gas vents 26 to heat the radially adjacent gates 18/mold cavities 20. It will be appreciated that combinations of these arrangements or patterns of gas vents 26 are also possible. For example, the arrangement of holes from ring to ring may be aligned or be radially offset to form a spiral pattern about the sprue 16. Where a plurality of gas vents 26 are employed, the gas vents 26 may have any suitable shape or size, including the shape of a cylindrical bore 44 or hole, and may be included in any suitable number and arrangement or pattern, including those described herein. Holes or bores 44 are particularly useful because they may be easily formed by drilling through the mold wall 12, such as drilling prior to investment of the mold 10 in the support medium 30. Holes or bores 44 may be formed in a predetermined number with each hole having a predetermined hole location and a predetermined hole size, where the hole sizes may be the same or different. The predetermined number of holes, the predetermined hole locations and the predetermined hole sizes may be configured to provide a substantially uniform thermal response characteristic within the mold 10. The uniform thermal response characteristic may be a substantially uniform temperature throughout the mold cavity 20 or cavities in response to application of heat from a hot gas source 80, such as a burner 81, directed into the sprue inlet 48. The predetermined number of holes, predetermined hole locations and predetermined hole sizes may be selected manually or modeled using a thermal model to provide a substantially uniform thermal response characteristic within the mold 10. In general, many smaller holes provide more even uniform heating and pattern 32 elimination than a few large holes. However, the number of holes may be limited by accessibility to mold sections for drilling. In one example, a 26-inch tall mold built around a 3-inch diameter sprue included 18-36 sprue holes having a diameter of 0.125 inch and provided the uniform temperature distribution and pattern 32 elimination characteristics described herein.

The gas vents 26 (e.g., holes) are covered by a gas permeable refractory cover 28. The gas permeable refractory cover 28 is disposed on an outer surface 42 of the mold wall 12. The gas permeable refractory cover 28 may be disposed on the outer surface 42 in any suitable manner, including by the use of a refractory bonding material 50. Any suitable gas permeable refractory cover 28 may be used to keep the support medium 30, such as foundry sand, out of the mold yet permit the passage of hot gas from the mold 10 into the support medium 30 to heat the medium and the outer surface 42 of the mold 10 and may include, for example, a metal screen including a refractory metal screen or a refractory material, including a porous refractory material, and more particularly a porous refractory fabric 46 or a porous refractory ceramic. An example of a suitable porous refractory fabric includes a porous refractory felt. Examples of porous refractory felts include commercially available refractory felts such as LYTHERM® or KAOWOOL®. In one embodiment, the gas permeable refractory cover 28 may include a strip of gas permeable refractory fabric 46. The refractory fabric 46 strips may be secured along their edges with a refractory bonding material 50, such as a refractory patching compound. To facilitate the placement of the gas vents 26 and associated refractory covers 28, certain portions of the pattern 32 in each ring of gates 18/mold cavities 20 may be omitted. The omitted patterns 32 may be extend axially in a column (e.g., FIG. 3) or extend circumferentially (e.g., FIGS. 1-3), or they may extend axially and circumferentially in a spiral configuration. An alternate approach is to fill the rings with patterns 32 but leave a sufficiently wide gap between adjacent rings, or every second or third ring to accommodate the placement of refractory fabric 46 strips.

The mold 10 may also incorporate a sprue outlet cover 52, such as a sand plug, to enclose the sprue outlet 54. The sprue outlet cover 52 covers the sprue outlet 54 and is configured to exclude any support medium 30 that is disposed against an outer surface of the cover from the sprue 16. The sprue outlet cover 52 also may be used to control the flow of hot combustion gas through the sprue and other portions of the mold 10 so as to prevent excessive backpressure and to enable the burner 81 to function properly. The sprue outlet cover 52 may be formed from any suitable material and, more particularly, it may comprise various refractory materials. The sprue outlet cover 52 may include a gas permeable cover or a gas impermeable cover. In order to facilitate the removal of the fugitive pattern assembly 40 from the mold cavities 20, gate 18 cavities and the sprue 16 cavity, and more particularly to promote combustion in the burner 81 and flow of the hot gas 60 through the sprue 16 cavity, the portion of the fugitive pattern 32 disposed in and defining the shape of the sprue 16 may include a sprue channel 56, FIG. 4, in fluid communication with and extending inwardly from the sprue inlet 48 toward the sprue outlet 54. In the case where the sprue outlet cover 52 includes a gas impermeable cover, the pattern assembly 40 may also include a vent channel 58, FIG. 4, in the fugitive pattern 32, the vent channel 58 in fluid communication with and extending from the sprue channel 56 to the gas vent 26. This arrangement facilitates the necessary flow to support combustion and the production of the hot gas 60 necessary when such flow is not possible through the sprue 16, such as because of the use of a gas impermeable sprue outlet cover 52.

Once the mold 10 has been formed on the pattern assembly 40, including the incorporation of gas vents 26 and refractory covers, such as refractory fabric strips 46, as described herein, as disclosed in U.S. Pat. No. 6,889,745 to Redemske, which is incorporated herein by reference in its entirety, a hot gas 60 is passed through the central sprue 16, including the sprue channel 56 FIG. 4, causing the fugitive material of the sprue to collapse 39, FIG. 1, such as by pyrolysis including melting and/or combustion of the fugitive material such that it is eliminated from the sprue 16 cavity and progressively through other portions of the mold, including the gate 18 cavities and mold cavities 20. Without being limited by theory, the hot gas 60, at higher than ambient pressure, passes through the, thus exposed, gas vents 26 and compresses the refractory fabric 46 against the support medium 30, creating a thin channel between the shell wall and the fabric. Also, since the refractory fabric 46 is gas permeable, it may also act as a peripheral channel for the hot gas 60. For example, the hot gas 60 may spread under the refractory fabric 46 before it diffuses through it, thereby producing a more dispersed flow through the fabric into the support medium 30. Through this channel or channels the hot gas 60 is evenly distributed around the periphery of the sprue. The hot gas 60 diffuses through the fabric and the support medium 30. For the circumferentially distributed gas vents 26 as shown in FIGS. 1-4, this diffusion of the hot gas 60 and heating of the support medium creates a temperature distribution 62 (i.e., a roughly isothermal region) within the support medium 30 that takes the approximate shape of a toroid with a pie-shaped cross-section. Due to the large surface-area-to-volume ratio of the support medium 30 grains in the case where a particulate medium, such as casting sand, is used the heat is efficiently transferred from the hot gas 60 to the support medium 30 and the outer surface of the mold 10. As the heat spreads, it heats the gates 18 and ultimately the portion of the patterns 32 in the gates from the outer surface through the mold wall 12 to the pattern material 33. Such heating causes the fugitive pattern material 33 in the gates 18 to shrivel and pyrolize, thereby opening channels 38 in the gates 18 for the passage of the hot gas 60 from the sprue 16 to the mold cavities 20. The process is continued until all fugitive pattern material 33 is eliminated and the mold 10 attains the desired temperature, such as a predetermined casting temperature.

An alternate venting approach is shown in FIG. 3. The gas vents 26 may be placed in columns and covered with vertically or axially-extending refractory covers 28 with reference to a longitudinal axis 64 of the mold 10. This approach is generally less efficient because more gates 18/mold cavities 20 must be left out and heat distribution through the gas vents 26 into the support medium 30 is less uniform. Holes comprising the gas vents 26 may be drilled in the sprue 16 proximate the base 66 of the gates 18 where they attach to the sprue 16, such as between the bases 66 of adjacent gates 18 and covered by strips of refractory fabric 46 that may be also be oriented axially or vertically. Holes may be drilled in the mold wall 12 of the sprue 16 (e.g., at the middle and top of the mold) or at the downward-facing base of the gates (e.g., at the bottom of the mold). Carbide tipped masonry drills or diamond grit tipped drills may be employed. In this approach, the formation of the channel or channels described above and distribution of the hot gas 60 flow is limited by the small area of the fabric or patch, so it generally takes longer to heat the support medium 30 and the outer surface 42 of the mold wall 12 sufficiently to pyrolize and remove the fugitive pattern material 33 in the gates 18 and mold cavities 20, as well as open any gas vents in the gates 18 to hot gas 60 flow.

Figure 5:
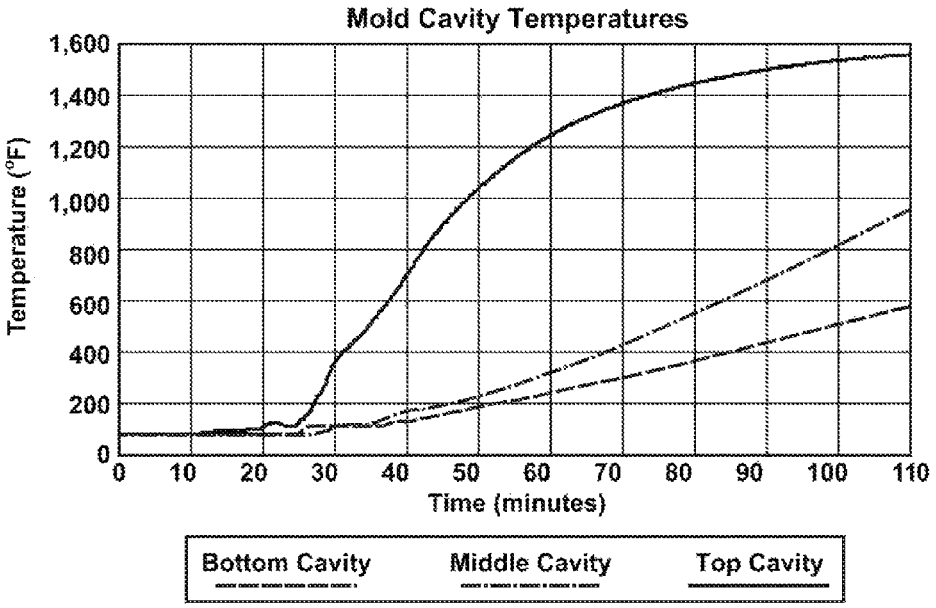
PRIOR ART FIG. 5
FIG. 5 is a plot of mold cavity temperature as a function of time for a related art refractory mold.
Figure 6:
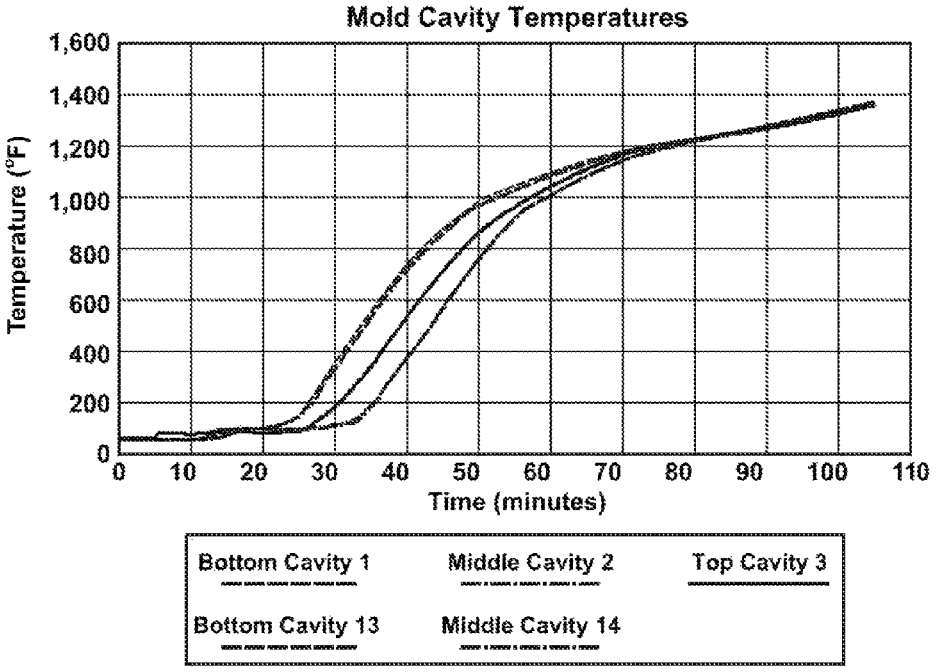
FIG. 6 is a plot of mold cavity temperature as a function of time for an exemplary embodiment of a refractory mold as disclosed herein.
Figure 7:
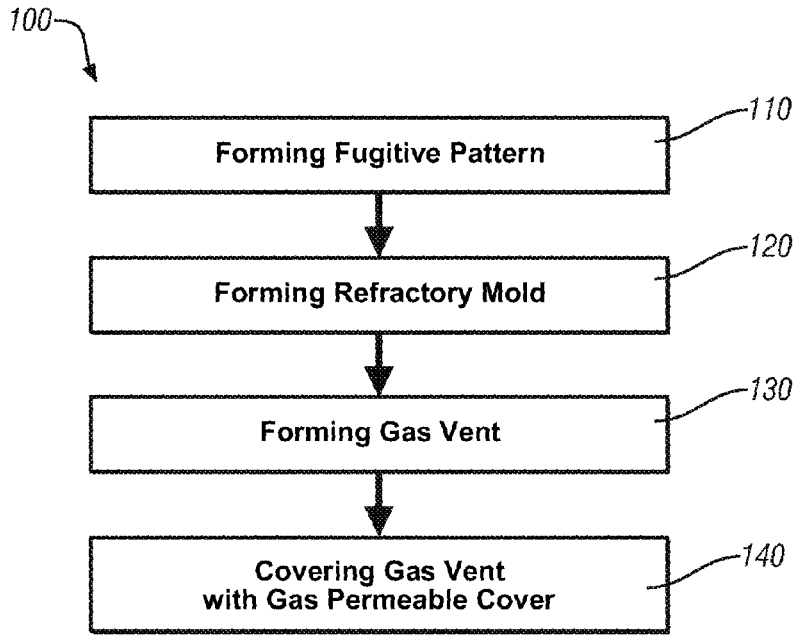
FIG. 7 is a flow diagram of an exemplary embodiment of a method of making a refractory mold as disclosed herein.
Figure 8:
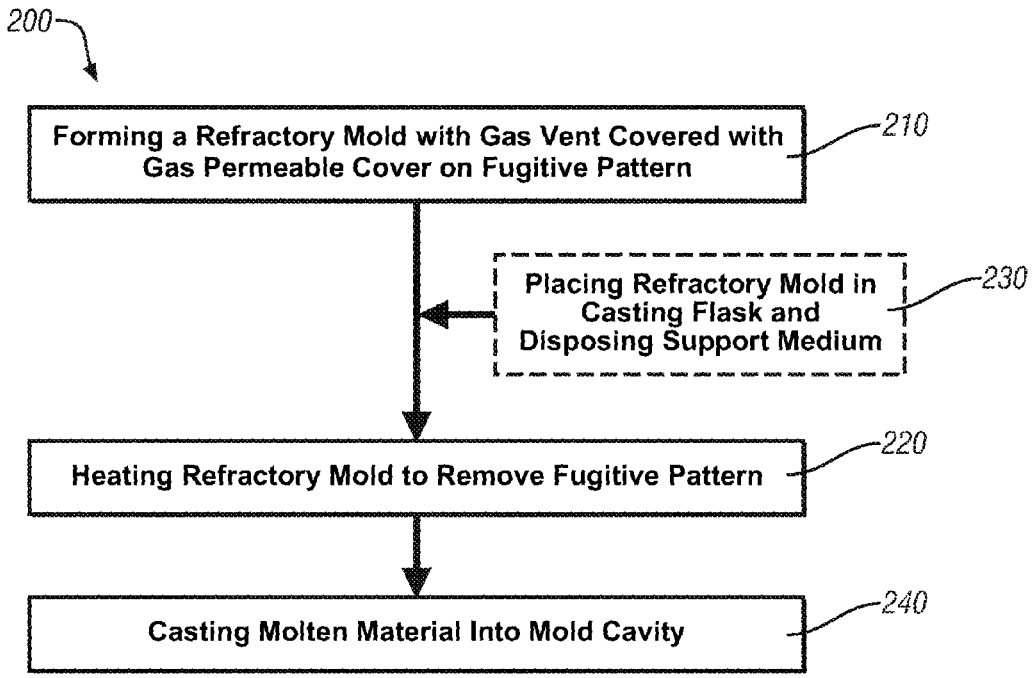
FIG. 8 is a flow diagram of an exemplary embodiment of a method of using a refractory mold as disclosed herein.

The use of gas vents 26 and gas permeable refractory covers 28 as described herein significantly improves the pattern 32 elimination process, and as such, greatly improves the associated moldmaking and casting processes that employ these molds, enabling reduced mold heating cycle times, higher productivity, reduced scrap rate and improved product quality associated with improved pattern 32 burnout and temperature uniformity within the mold. Gas vents 26 that pass gas, but do not allow the support medium 30 to enter the mold or molten metal to leave the mold, are made in mold walls to facilitate the passage of hot combustion gas 60 into the support medium 30 around the mold 10 that is contained by the casting flask. Once the combustion products pass through the mold wall 12, they diffuse through the support medium 30 with very little resistance (i.e., high permeability), heating the medium and mold wall 12 of the gates 18 and mold cavities 20. The mold wall 12 transmits the heat to the fugitive pattern material 33, causing it to shrink, FIG. 1 from the walls opening channels 38 as described herein. Passageways, thus opened, increase flow of the hot gas 60 inside the mold 10. Combined heating from the inside and outside provide for uniform, efficient pattern 32 elimination. The significance of the improvement may be understood by comparing the molds and methods of using the molds described herein to molds and methods of their use described, for example, in U.S. Pat. No. 6,889,745, which do not include the gas vents 26 or gas permeable refractory covers 28 described herein. These molds that do not incorporate the gas vents 26 provide a less uniform temperature distribution and require much more time for pattern 32 elimination. This is so because just a small area of the fugitive material is exposed to the hot gas in the gates and the gas flow is limited by mold wall permeability. FIGS. 5 and 6 illustrate actual temperature measurements at top, middle and bottom mold cavities of identical molds with (FIG. 6) and without (FIG. 5) sprue venting. Faster pattern 32 elimination and more uniform heating of the mold cavities of the vented mold 10 is clearly evident.

Referring to FIGS. 1-4, the bonded refractory shell mold 10 is placed in the casting chamber 29 of the casting flask 31 with the refractory conduit(s) 11, particularly the sprue inlet 48 extending outside of the flask 31. Refractory mold 10 then is surrounded with support medium 30, particularly a compacted un-bonded refractory particulate medium as described herein. After the support medium 30 has covered the bonded refractory shell mold 10 and has filled the casting chamber 29 the upper end of the casting flask 31 is generally closed off using a closure 70, such as a moveable top cover 72 or a diaphragm (not shown), to exert a compressive force on the particulate support medium 30 so that the support medium 30 remains firmly compacted. A screened port or ports 74, which along with an o-ring seal 76 is usually part of the closure 70, is provided to enable the flow of cooled combustion gas 61 out of the casting chamber 29 while the screened port 74 retains the support medium 30 therein. U.S. Pat. No. 5,069,271 to Chandley et al. describes use of particulate support medium 30 about a thin shell mold 10 and is incorporated herein by reference.

Pursuant to one embodiment, the casting flask 31 and mold are moved to a hot gas source 80 and lowered to position the sprue inlet 48 into the hot gas 60 flow, FIG. 1, such that the hot gas 60 flows through the conduit 11, including the sprue channel 56 and vent channel 58, and through the gas vents 26 into the support medium 30. As the pattern assembly 40 and support medium 30 are heated, the fugitive pattern material 33 pulls back from the mold wall 12 further assisting the heating and pyrolysis and elimination of the pattern material 33 as described herein. The gas can be heated by any means such as electrically heated or preferably by gas combustion. The temperature of the hot gas can vary between about 427° C. (800° F.) and about 1204° C. (2200° F.) depending upon the metal or alloy to be cast and the desired amount of mold 10 heating.

The hot gas 60 is caused to flow through refractory conduits 11 into the mold cavities 20 and through the gas permeable bonded refractory mold wall 12 by creating a differential pressure effective to this end between the mold cavity 20 and the region occupied by the particulate support media 30 in casting chamber 29. For purposes of illustration and not limitation, typically 0.5 to 0.9 atmospheres pressure differential is imposed across the mold wall 12. In accordance with an embodiment of the invention, this differential pressure can be established by applying a sub-atmospheric pressure (vacuum) to the screened chamber port 74 that in turn communicates the vacuum to the unbonded particulate support medium 30 disposed about the bonded refractory shell mold 10 in casting chamber 29. Use of subambient pressure at port 74 enables the hot gas 60 being delivered to the refractory conduit 11 and the mold interior (including mold cavities 20) to be at atmospheric pressure. A higher vacuum can be applied at port 74 to increase the flow rate of hot gas 60 that is flowed through the mold cavities 20 and mold wall 12, as well as gas vents 26. Alternately, hot gas 60 flow into the shell mold 10 and through the mold cavities 20 and gas permeable mold wall 12 can be effected by applying a pressure of the hot gas 60 higher than atmospheric pressure into the refractory conduits 11 and, thereby, the mold interior, while maintaining the exterior of the shell mold 10 (e.g. particulate support medium 30 in the casting flask 31) at a pressure close to ambient. For example, a superambient pressure (e.g. 14 psig) of the hot gas 60 can be provided to the refractory conduit 11 using a high pressure burner 81 available, for example, from North American Mfg. Co. This embodiment can force a higher mass of hot gas 60 through the shell mold 10, thereby resulting in shorter mold heating times. A combination of both of the above-described vacuum and pressure approaches can also be used in practice of the invention disclosed herein.

The mold wall 12 defining the mold cavities 20 is heated to the desired temperature for casting of molten metal or alloy in mold cavities 20 by the continued flow of hot gas 60 into the support medium 30 through the gas vents and through the permeable bonded refractory mold wall 12 when the wall is gas permeable. The hot gas temperature, the heating time and the flow rate through the gas vents 26 and across the gas permeable bonded refractory mold wall 12 controls the final temperature of the interior surface of mold wall 12 in mold cavities 20. After the mold 10, and particularly the mold cavities, has reached the desired temperature for casting, the flow of hot gas 60 from hot gas source 80 is discontinued, and molten metal or alloy is cast into the heated mold cavities 20. When an unbonded particulate support medium 30 is disposed about the shell mold 10, the mold wall 12 as well as some distance into the unbonded support medium 30 are heated during flow of the hot gas 60 through the gas vents 26 and mold wall 12. A favorably small temperature gradient is established in the particulate support medium 30, which aids in the maintenance of the surface temperature of the mold wall 12 and particularly in mold cavities 20 between when the hot gas 60 flow is discontinued and the mold 10 is cast as illustrated, for example, in FIG. 6. This is particularly advantageous as compared to the conventional heating of conventional investment casting molds, which are typically heated in an oven to eliminate the pattern 32 and to preheat the mold and then transferred into the casting chamber where the support medium is added to surround the mold followed by casting, since the addition of the support medium is known to substantially and undesirably lower the mold temperatures prior to casting. The presence of the support medium 30 during elimination of the pattern assembly 40 to heat the outer surface of the mold 10, mold wall 12 and mold cavities 20 is very advantageous for all types of molds 10 as described herein. The energy efficiency of the mold cavity 20 heating method disclosed herein is very high. When the support medium 30 is used, the bonded refractory shell mold 10 and the un-bonded support medium 30 absorb almost all of the heat from the hot gas 60 that enters the mold. This compares, for example, to less than 5% of the heat that is absorbed by a mold in mold heating furnaces typically used in investment casting. In the typical investment casting furnace, over 95% of the energy is wasted as the hot gases travel up the exhaust stack of the furnace.

The fugitive pattern assembly 40 is removed during mold heating as described. The hot gas 60 flow is initially directed primarily at the pattern assembly 40, causing it to pyrolize, to melt and to vaporize. The forcing of hot gas 60 to flow through the bonded refractory mold wall 12 and gas vents 26 as described herein causes the pattern 32 removal to occur faster than would occur without the use of gas vents 26.

The hot gas 60 from hot gas source 80 can have strong oxidizing, neutral or reducing potential depending upon the desire to remove carbonaceous pattern material 33 residue from the mold cavities 20. It should be noted that the ability to oxidize carbonaceous pattern material 33 residue is vastly enhanced by the forced flow of oxidizing gas through all areas of the mold cavities 20 and through the bonded refractory mold wall 12. The oxidation of the pattern material 33 residue can also generate heat that can be used to increase the temperature of the bonded refractory mold 10.

Typically, mold temperature of 1,100° F. to 1,400° F. is needed to ensure complete elimination of pattern material 33.

For low melting temperature alloys, such as aluminum and magnesium such mold temperature is too high for casting. The mold can be cooled using the burner 81 by increasing the air to fuel ratio (excess air). For example, 400% excess air will cool the mold 20 below 700° F. in 15 minutes.

Another embodiment of the invention involves mold heating to adjust the temperature of a previously heated shell mold 10, including gas vents 26 and gas permeable covers 28, after it is placed in support medium 30. In this embodiment, the bonded refractory mold 10 initially is heated in an oven (not shown) at a high enough temperature to remove the pattern material 33 residue. The hot bonded refractory mold 10 then is removed from the oven, placed in casting chamber 29 of casting flask 31, and the particulate support medium 30 is compacted around the mold 10. Such a mold 10 typically will have a reduced mold wall thickness and therefore require the application of the particulate support media 30 during casting to prevent mold failure. Such a thin shell mold, however, cools off more quickly than a thicker-wall shell mold following removal from the mold preheat oven and after surrounding with support medium 30. This fast cooling leads to a lower mold temperature at the time of casting. Low mold wall temperatures can contribute to defects such as misruns, shrinkage, entrapped gas and hot tears, especially in thin castings. Therefore, the temperature of the mold wall 12 is increased back to the desired range by the flowing of the hot gas 60 from hot gas source 80 through refractory conduit 11 into the mold cavity 20 and through the gas permeable mold wall into the support medium 30, as well as through gas vents 26 into the support medium 30. This flow of hot gas is caused by the creation of a pressure higher in the mold cavity 20 than the pressure exterior of the mold wall 12 as described above. After the shell mold 10 has reached the desired temperature, the flow of hot gas 60 is discontinued and molten metal is cast into the reheated mold cavities 20.

Referring to FIGS. 1-7, in one embodiment, a method 100 of making a bonded refractory mold 10 is disclosed. The method includes forming 110 a fugitive pattern 32, such as fugitive pattern assembly 40 that includes a thermally removable or fugitive material as described herein. The method 100 also includes forming 120 a refractory mold 10 comprising a mold wall 12 as described herein. The mold wall 12 comprises a refractory material 14 and defines a sprue 16, a gate 18 and a mold cavity 20 as described herein. The mold 10 is defined by the fugitive pattern 32, such as pattern assembly 40. The gate 18 has a gate inlet 22 opening into the sprue 16 and a gate outlet 24 opening into the mols cavity 20. The method 100 further includes forming 130 a gas vent 26 that extends through the mold wall 12. Still further, the method 100 includes covering 140 the gas vent 26 with a gas permeable cover 28 as described herein.

Forming 110 of the fugitive pattern 32 may include assembling a plurality of pattern portions into a pattern assembly 40 as described herein. The thermally removable or fugitive material 33 of the fugitive pattern 32 may include a wax or a polymer, or a combination thereof. The pattern portions may be assembled by any suitable assembly method, including the use of adhesives and molten wax as are commonly used in patternmaking. Forming 110 the fugitive pattern 32 may include forming a sprue channel 56 in a portion of the fugitive pattern 32 located in the sprue 16 that is in fluid communication with and extends inwardly from a sprue inlet 48 toward a sprue outlet, and further comprising covering a sprue outlet 54 with a sprue outlet cover 52, the sprue outlet cover covering the sprue outlet 54 and configured to exclude a support medium 30 disposed against an outer surface of the cover from the sprue 16. As noted herein, the sprue outlet cover 52 may include a gas permeable cover or a gas impermeable cover. Where the sprue outlet cover 52 includes a gas impermeable cover, the method 100 may also include forming a vent channel 58 in the fugitive pattern 32, such as pattern assembly 40, the vent channel 58 in fluid communication with and extending from the sprue channel 56 to the gas vent 26. In one embodiment, forming 110 the vent channel 58 and forming 130 the gas vent 26 may include drilling a hole through the mold wall 12 and pattern 32 that opens into the sprue channel 56.

Forming 120 the refractory mold 10 may be performed in any suitable manner and any suitable method, including disposing a bonded ceramic on the fugitive pattern 32, such as pattern assembly 40, as described herein. Disposing the bonded ceramic may be performed in any suitable manner and any suitable method, including by applying a plurality of ceramic particles disposed in an inorganic binder, such as a slurry of these materials, on the fugitive pattern 32 by dipping or otherwise, as described herein. As noted, applying a plurality of ceramic particles disposed in an inorganic binder on the fugitive pattern 32 may include applying a plurality of successive layers of the ceramic particles and the inorganic binder on the fugitive pattern 32, such as pattern assembly 40, as described herein. This may include, for example, dipping the pattern assembly 40 in a slurry of the ceramic particles disposed in an inorganic binder to form a layer and then drying the layer followed by repeating the process for a predetermined number of layers, as described herein.

Forming 130 a gas vent 26 that extends through the mold wall 12 may be performed in any suitable manner and by any suitable method, including forming a hole through the mold wall 12. Forming a hole through the mold wall 12 may be performed in any suitable manner and by any suitable method, including drilling a hole through the mold wall 12 as described herein, including drilling a hole in the gate or the sprue. Further, this may include forming 130 a plurality of gas vents 26, which may include forming a plurality of gas vents 26 in the gate 18 or the sprue 16, or a combination thereof, such as by drilling a plurality of holes through the mold wall 12. Drilling the plurality of holes through the mold wall 12 may include drilling a predetermined number of holes, each hole having a predetermined hole location and a predetermined hole size, as described herein. Drilling may also include configuring the predetermined number of holes, the predetermined hole locations and the predetermined hole sizes to provide a substantially uniform thermal response characteristic within the mold. Providing the predetermined response characteristic may include heating the mold 10 by applying heat, such as hot gas 60, from a heat source, such as hot gas source 80, into the sprue inlet 48 of the sprue 16 to remove the thermally removable material 33 of the pattern 32, wherein the substantially uniform thermal response characteristic comprises a substantially uniform temperature of the mold cavities 20 as shown in FIG. 6.

Covering 140 the gas vent 26 with a gas permeable cover 28 may include disposing a refractory metal screen or a porous refractory material on an outer surface 42 of the mold 10 to cover the gas vent 26. Disposing a porous refractory material may include disposing a porous refractory fabric 46 on the outer surface 42 of the mold in the manner described herein.

Referring to FIGS. 1-6 and 8, a method 200 of using a bonded refractory mold 10 is disclosed. The method 200 of using the mold includes: forming 210 a refractory mold 10 as described herein. The mold 10 comprises a mold wall 12 disposed on a fugitive pattern 32 comprising a thermally removable material 33, the mold wall 12 comprising a refractory material 14 and defining a sprue 16, a gate 18 and a mold cavity 20, the gate 18 having a gate inlet 22 opening into the sprue 16 and a gate outlet 24 opening into the mold cavity 20; a gas vent 26 extending through the mold wall 12; and a gas permeable refractory material 46 covering the gas vent 26, the fugitive pattern 32 having a sprue portion, the sprue portion having a sprue channel 56 that is in fluid communication with a sprue inlet 48 and that extends toward a sprue outlet 54. The method 200 also includes heating 220 the refractory mold 10 with a hot gas 60 to remove the thermally removable material 33, wherein a portion of the hot gas 60 is exhausted from the refractory mold 10 through the gas vent 26.

Heating 220 may be performed by any suitable heating method or heating apparatus, particularly by using a hot gas source 80, such as a burner 81, as described herein. In one embodiment, heating 220 may include heating an inner surface 43, particularly the portion of the inner surface 43 comprising the mold cavity 20, and an outer surface 42 of the mold 10 by causing the hot gas 60 to pass through the gas vent 26 and the gas permeable mold wall 12. The inner surface 43 of the mold 10 may be heated by the hot gas 60 comprising an exhaust flow of a burner 81 into the sprue inlet 48. In certain embodiments, where the mold 10 is to be filled by countergravity casting, the sprue inlet 48 is located on a bottom surface 45 of the mold 10. In certain other embodiments, where the mold 10 is to be filled by gravity casting, the sprue inlet 48 is located on a top surface 47 of the mold 10. In one embodiment, the refractory mold 10 further includes a gas permeable sprue outlet cover 52 covering the sprue outlet 54, wherein a first portion of the hot gas 60 flow passes through the cover and a second portion flows through the remainder of the system, including the gas vent 26 or vents and the mold wall 12 (where the mold wall 12 is gas permeable). The first portion and second portion of the hot gas 60 (e.g., hot exhaust gas) flow may be apportioned in any suitable manner. For example, one may be greater than the other. When the gas vent 26 comprises a plurality of gas vents 26, the second portion of the exhaust flow passes through the plurality of gas vents 26. The plurality of gas vents 26 may include a predetermined number of holes, each hole having a predetermined hole location and a predetermined hole size, and the method 200 and heating 220 may also include configuring the predetermined number of holes, the predetermined hole locations and the predetermined hole sizes to provide a substantially uniform thermal response characteristic within the mold 10 during heating 220, and configuring the holes, location and sizes so that the substantially uniform thermal response characteristic comprises maintaining a substantially uniform temperature at a plurality of locations within the mold cavity 20 during heating 220. In one embodiment, maintaining a substantially uniform temperature at a plurality of locations includes maintaining a substantially uniform temperature in a bottom portion of the mold cavity 20 and in a top portion of the mold cavity 20, or in molds having a plurality of axially separated layers or tiers of mold cavities 20, at a mold cavity 20 located in the bottom (or a lower) tier and at a mold cavity 20 located in the top (or an upper) tier. In another embodiment, maintaining a substantially uniform temperature at a plurality of locations includes maintaining a substantially uniform temperature within a tier of radially spaced mold cavities, and more particularly, in mold cavities 20 in a plurality of radially separated locations around a periphery of the mold 10. Alternately, maintaining a substantially uniform temperature at a plurality of locations may include maintaining a substantially uniform temperature within both axially and radially spaced mold cavities 20.

In another embodiment, where the refractory mold 10 comprises a gas impermeable sprue outlet cover 52 covering the sprue outlet 54, the pattern assembly 40 may include a vent channel 58 in fluid communication with and extending from the sprue channel 56 to the gas vent 26, wherein a portion of the exhaust flow passes through the vent channel 58 and the gas vent 26.

The method may also include placing 230 the mold in a casting flask 31 and disposing a support medium 30 around the refractory mold 10 in the casting flask 31 to support the refractory mold 10 sufficiently to enable casting of a molten metal into the mold cavity 20. The mold may be placed in the support medium prior to heating 220 for removing the thermally removable material 33. As described herein, the support medium 30 will preferably be used to provide a characteristic thermal response, including temperature uniformity during heating 220, particularly when the mold 10 includes thin mold walls such that it may not be self-supporting during pattern elimination and casting and/or is subject to high thermal losses without the presence of the support medium 30.

The method 200 of using the bonded refractory mold 10 may also include casting 240 a molten material into the mold cavity 20 as described herein. The casting 240 may include conventional gravity casting or countergravity casting. This includes all manner of gravity or countergravity casting, including centrifugal casting methods where the mold 10 and casting flask 31 are rotated during casting.

The terms "a" and "an" herein do not denote a limitation of quantity, but rather denote the presence of at least one of the referenced items. The modifier "about" used in connection with a quantity is inclusive of the stated value and has the meaning dictated by the context (e.g., includes the degree of error associated with measurement of the particular quantity). Furthermore, unless otherwise limited all ranges disclosed herein are inclusive and combinable (e.g., ranges of "up to about 25, more particularly about 5 to about 20 and even more particularly about 10 to about 15" are inclusive of the endpoints and all intermediate values of the ranges, e.g., "about 5 to about 25, about 5 to about 15", etc.). The use of "about" in conjunction with a listing of constituents of an alloy composition is applied to all of the listed constituents, and in conjunction with a range to both endpoints of the range. Finally, unless defined otherwise, technical and scientific terms used herein have the same meaning as is commonly understood by one of skill in the art to which this invention belongs. The suffix "(s)" as used herein is intended to include both the singular and the plural of the term that it modifies, thereby including one or more of that term (e.g., the metal(s) includes one or more metals). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A method of making a bonded refractory mold, comprising:

forming a fugitive pattern comprising a thermally removable material;

forming a refractory mold comprising a mold wall, the mold wall comprising a refractory material and defining a sprue, a gate and a mold cavity, the sprue having a sprue outlet on an end thereof, the gate having a gate inlet opening into the sprue and a gate outlet opening into the mold cavity, the mold defined by the fugitive pattern;

forming a gas vent comprising a discrete aperture extending through the mold wall in at least one of the gate or the sprue, other than the sprue outlet; and covering the gas vent with a gas permeable cover that is disposed on an outer surface of the mold wall and covers the aperture, the gas permeable cover configured to exclude a support medium surrounding the mold from passage into the mold through the aperture.

2. The method of claim 1, wherein forming the fugitive pattern comprises assembling a plurality of pattern portions.

3. The method of claim 1, wherein the thermally removable material comprises a wax or a polymer, or a combination thereof.

4. The method of claim 1, wherein forming the fugitive pattern comprises forming a sprue channel in a portion of the fugitive pattern located in the sprue that is in fluid communication with and extends inwardly from a sprue inlet toward the sprue outlet, and further comprising covering the sprue outlet with a sprue outlet cover, the sprue outlet cover covering the sprue outlet and configured to exclude the support medium disposed against an outer surface of the cover from the sprue.

5. The method of claim 4, wherein the sprue cover comprises a gas permeable cover.

6. The method of claim 4, wherein the sprue cover comprises a gas impermeable cover, and further comprising forming a vent channel in the fugitive pattern, the vent channel in fluid communication with and extending from the sprue channel to the gas vent.

7. The method of claim 6, wherein forming the vent channel and forming the gas vent comprise drilling a hole through the mold wall and pattern that opens into the sprue channel.

8. The method of claim 1, wherein forming a refractory mold comprises disposing a bonded ceramic on the fugitive pattern.

9. The method of claim 8, wherein disposing the bonded ceramic comprises applying a plurality of ceramic particles disposed in an inorganic binder on the fugitive pattern.

10. The method of claim 9, wherein applying a plurality of ceramic particles disposed in an inorganic binder on the fugitive pattern comprises applying a plurality of successive layers of the ceramic particles and the inorganic binder on the fugitive pattern.

11. The method of claim 1, wherein forming a gas vent that extends through the mold wall comprises forming the aperture in the mold wall.

12. The method of claim 11, wherein forming the aperture in the mold wall comprises drilling a hole through the mold wall.

13. The method of claim 12, wherein forming the aperture through the mold wall comprises drilling a hole in at least one of the gate or the sprue.

14. The method of claim 1, wherein forming a gas vent that extends through the mold wall comprises forming a plurality of gas vents.

15. The method of claim 14, wherein forming a gas vent that extends through the mold wall comprises forming a plurality of gas vents in the gate or the sprue, or a combination thereof.

16. The method of claim 14, wherein forming the plurality of gas vents comprises drilling a plurality of holes through the mold wall.

17. The method of claim 16, wherein drilling the plurality of holes through the mold wall comprises drilling a predetermined number of holes, each hole having a predetermined hole location and a predetermined hole size.

18. The method of claim 17, further comprising configuring the predetermined number of holes, the predetermined hole locations and the predetermined hole sizes to provide a substantially uniform thermal response characteristic within the mold.

19. The method of claim 18, further comprising heating the mold by applying heat from a heat source into an inlet of the sprue to remove the thermally removable material of the pattern, wherein the substantially uniform thermal response characteristic is a substantially uniform temperature of the mold cavity.

20. The method of claim 1, wherein covering the gas vent with a gas permeable cover comprises disposing a metal screen or a porous refractory material on an outer surface of the mold to cover the gas vent.

21. The method of claim 1, wherein forming a gas vent further comprises a discrete aperture extending through the mold wall in the mold cavity.

* * * * *